US012428960B2

(12) United States Patent
Wang

(10) Patent No.: US 12,428,960 B2
(45) Date of Patent: Sep. 30, 2025

(54) SYSTEMS AND METHODS FOR WELL TESTING

(71) Applicant: Schlumberger Technology Corporation, Sugar Land, TX (US)

(72) Inventor: Chao Wang, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/482,974

(22) Filed: Oct. 9, 2023

(65) Prior Publication Data

US 2025/0116191 A1 Apr. 10, 2025

(51) Int. Cl.
*E21B 49/08* (2006.01)
*E21B 33/12* (2006.01)
*E21B 47/06* (2012.01)

(52) U.S. Cl.
CPC ..... *E21B 49/081* (2013.01); *E21B 33/12* (2013.01); *E21B 47/06* (2013.01)

(58) Field of Classification Search
CPC ..... E21B 49/081; E21B 33/12; E21B 47/06; E21B 49/08; E21B 49/083; E21B 49/087; E21B 49/088; E21B 49/00; E21B 49/003; E21B 49/008
See application file for complete search history.

(56) References Cited

U.S. PATENT DOCUMENTS 3,163,211 A * 12/1964 Henley ..... E21B 49/00 73/152.41
4,766,957 A * 8/1988 McIntyre ..... E21B 43/385 166/66.4
5,335,732 A 8/1994 McIntyre
6,131,660 A 10/2000 Stuebinger
6,357,525 B1 * 3/2002 Langseth ..... E21B 49/088 166/266
6,382,315 B1 5/2002 Langseth
6,457,522 B1 * 10/2002 Bangash ..... E21B 43/40 166/263
6,467,340 B1 * 10/2002 Gallagher ..... E21B 37/06 73/61.41
8,776,591 B2 7/2014 Le Foll
2001/0050170 A1 12/2001 Woie
2003/0141073 A1 7/2003 Kelley
2018/0171788 A1 * 6/2018 Waid ..... E21B 49/088
2018/0283735 A1 * 10/2018 Song ..... E21B 43/305

(Continued)

FOREIGN PATENT DOCUMENTS

EP 2122120 B1 6/2019
WO 9915755 A2 4/1999

(Continued)

OTHER PUBLICATIONS

REDA Multiphase HPS, Horizontal Multistage surface pump, 2022 (1 page).

(Continued)

*Primary Examiner* — Yanick A Akaragwe
(74) *Attorney, Agent, or Firm* — Jeffrey D. Frantz

(57) ABSTRACT

A well testing package is coupled to a well. A first fluid is produced from a first production zone of the well to the well testing package. The first fluid is returned to the well from the well testing package, and is injected into a second production zone of the well.

13 Claims, 6 Drawing Sheets

(56) References Cited

U.S. PATENT DOCUMENTS

| | | | | |
|---|---|---|---|---|
| 2019/0063216 | A1* | 2/2019 | Bouldin | E21B 47/10 |
| 2020/0240255 | A1* | 7/2020 | Forthuber | C02F 1/38 |
| 2023/0193755 | A1 | 6/2023 | Chen | |

FOREIGN PATENT DOCUMENTS

| | | | |
|---|---|---|---|
| WO | 2022115758 | A1 | 6/2022 |
| WO | 2023075815 | A1 | 5/2023 |

OTHER PUBLICATIONS

Vx Spectra—Surface Multiphase Flowmeter, 2023 (2 pages).
Y-Tool and Bypass System, Well access below your ESP, 2008 (2 pages).
Tankiyev et al., Innovative, Cost Effective and Zero Flaring Solution to Clean-Up and Start-Up New Wells in High H2S Field in Kazakhstan. The Vital step forward towards Net Zero Carbon Footprint, SPE-210099-MS, prepared and presented at the 2022 SPE Annual Technical Conference and Exhibition held in Houston, TX, USA, Oct. 3-5, 2022 (11 pages).
Search Report and Written Opinion issued in the PCT Application No. PCT/US2024/050345 dated Jan. 20, 2025, 10 pages.

* cited by examiner

SYSTEMS AND METHODS FOR WELL TESTING

BACKGROUND

Wells are drilled in order to access fluids, such as hydrocarbons, that are present in subterranean formations. Operators test wells in order to ascertain information concerning the subterranean formations (such as in situ pressures, permeability, and productivity/injectivity), as well as the composition and properties of fluids produced from the subterranean formations. Fluids produced from subterranean formations are often multiphase fluids including two or more of water, oil, or gas.

Operators perform well testing using a well testing package including equipment that is temporarily coupled to a well for the duration of a test. Typically, the well testing equipment is located at the surface, such as at a wellsite on land or on an offshore installation (such as a drilling vessel). The well testing equipment can include a separator that facilitates separation of a multiphase fluid, such as into gas, water, and oil phases. In most well testing cases, separated hydrocarbons are burned at the wellsite through a burner.

Typically, a well test includes the flaring of hydrocarbons because of a lack of available infrastructures to handle the hydrocarbons economically. The flaring of hydrocarbons is wasteful, and is considered to be detrimental to the environment. Indeed, some jurisdictions have initiated measures to restrict the practice of flaring when conducting well tests. Thus, there is a need for systems and methods to mitigate the adverse effects of flaring.

SUMMARY

Aspects of the present disclosure provide systems, apparatus, and methods for testing wells. In one aspect, a method of testing first and second production zones of a well includes coupling a well testing package to the well, and producing a first fluid from the first production zone to the well testing package. The method further includes returning the first fluid from the well testing package to the well, and injecting the first fluid into the second production zone.

In another aspect, a method of testing first and second production zones of a well includes installing a well test completion into the well, the well test completion including first and second tubing strings. In some aspects, the well test completion is a temporary completion that is removed from the well after testing the well. The method includes coupling a well testing package to the well, and producing a first fluid from the first production zone through the first tubing string to the well testing package. The method further includes pumping the first fluid from the well testing package into the second tubing string, and injecting the first fluid into the second production zone.

In another aspect, a completion system for testing first and second production zones of a well includes an upper packer, an upper test completion, and a lower test completion. The upper test completion is coupled to the upper packer, and includes a bypass tool that includes a branch bore intersecting a main bore. The upper test completion further includes a first valve coupled to the branch bore, and a first gauge carrier coupled to the first valve. The lower test completion is coupled to the main bore of the bypass tool, and includes a second valve. The lower test completion further includes a second gauge carrier that is coupled to the second valve.

The following description and the appended figures set forth certain features for purposes of illustration.

BRIEF DESCRIPTION OF DRAWINGS

The appended figures illustrate only exemplary embodiments and are therefore not to be considered limiting of the scope of the disclosure, as the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Aspects of the present disclosure provide systems, apparatus, and methods for testing a well. In some embodiments, the well is land-based. In some embodiments, the well is offshore. A well test completion installed in the well segregates a first fluid flow path from a second fluid flow path. The first fluid flow path runs from a first production zone of the well to a wellhead, and the second fluid flow path runs from a second production zone of the well to the wellhead. The second production zone is discrete from the first production zone. In some embodiments, the testing of the well is performed without flaring or venting hydrocarbons produced from the well. In some embodiments, fluids produced from a well are returned to the well. In some of such embodiments, the fluids produced from the first production zone via the first fluid flow path are pumped via the second fluid flow path, and injected into the second production zone. In some embodiments, the well test completion is a temporary completion that is removed from the well after testing the well.

Figure 1:
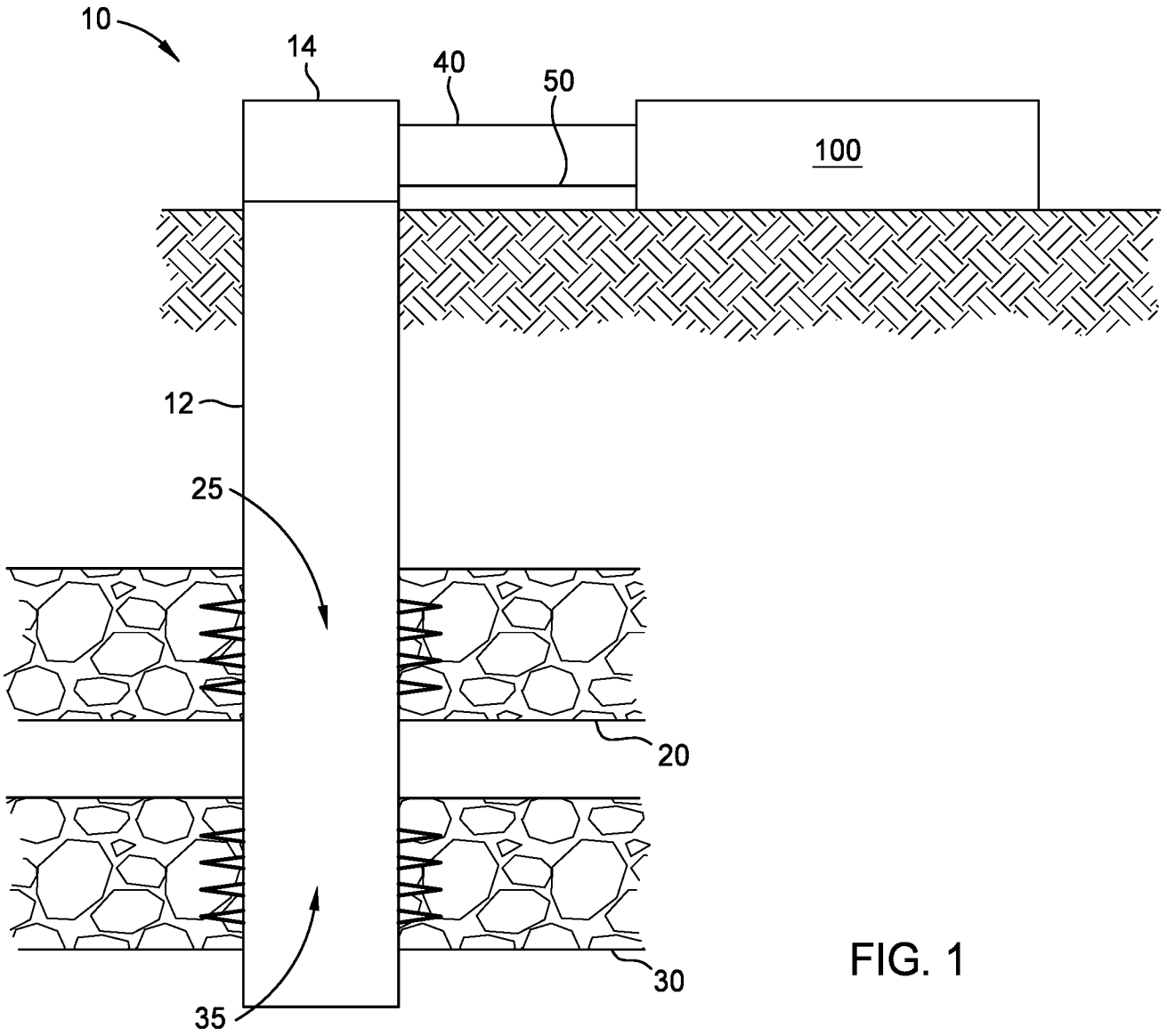
FIG. 1 schematically illustrates a well testing package deployed at a wellsite.

FIG. 1 schematically illustrates a well testing package 100 deployed at a wellsite 10. In some embodiments, the wellsite 10 is on land. In some embodiments, the wellsite 10 is offshore, and the well testing package 100 is on an offshore installation, such as a drilling vessel.

A well 12 at the wellsite 10 extends into a first geological formation 20 and into a second geological formation 30. The well 12 includes a first production zone 25 at the first geological formation 20, and includes a second production zone 35 at the second geological formation 30. As illustrated, in some embodiments, the first geological formation 20 is discrete from the second geological formation 30. In an example, the first geological formation 20 and the second geological formation 30 are separated by an intermediate geological formation, such as a shale layer. In some embodiments, the first geological formation 20 and the second geological formation 30 are different portions of a common geological formation. As illustrated, in some embodiments, the first geological formation 20 and the second geological formation 30 are vertically separated. In some embodiments, the first geological formation 20 and the second geological formation 30 are laterally separated.

A wellhead 14 is shown installed on the well 12, and coupled to the well testing package 100 by a production line 40 and an injection line 50. The production line 40 conveys fluids produced from the well 12 to the well testing package 100; the injection line 50 conveys fluids from the well testing package 100 to the well 12.

Figure 2A:
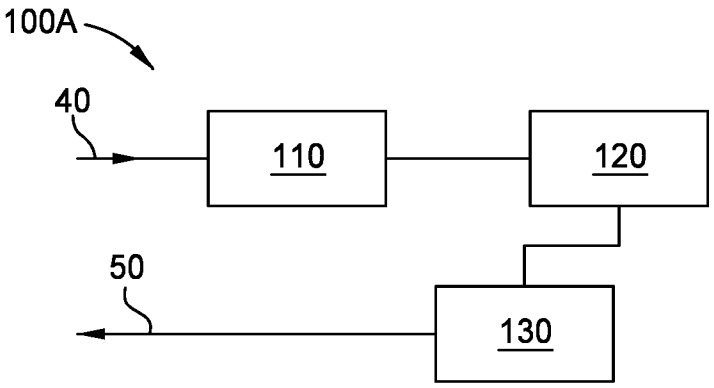
FIGS. 2A to 2D schematically illustrate exemplary arrangements of equipment of the well testing package of FIG. 1.

FIGS. 2A to 2D schematically illustrate exemplary arrangements of equipment of the well testing package 100. In FIG. 2A, the well testing package 100 is represented by well testing package 100A. A choke manifold 110 is coupled to the production line 40. Fluids conveyed from the well 12 through the production line 40 are routed from the choke manifold 110 to a multiphase flowmeter 120. The multiphase flowmeter 120 measures flowrates of the fluids, such as mass flowrates, volumetric flowrates, or molar flowrates. In some embodiments, the fluids include one or more of a gas phase, an oil phase, or a water phase; the multiphase flowmeter 120 facilitates flowrate measurements of each of the gas phase, the oil phase, and the water phase present in the fluids. The multiphase flowmeter 120 may operate according to any technique known in the art, such as nuclear spectroscopy flow measurement, optical flow measurement, magnetic resonance flow measurement, Coriolis flow measurement, or ultrasonic flow measurement, etc.

Fluids are routed from the multiphase flowmeter 120 to a multiphase pump 130. The multiphase pump 130 may operate using any technique known in the art, such as positive displacement pumping, roto-dynamic pumping, etc. The multiphase pump 130 boosts the pressure of the fluids, and conveys each phase of the fluids back to the well 12 via the injection line 50. In some embodiments, the well testing package 100A is operated without flaring or venting any portion of the fluids arriving via the production line 40.

Figure 2B:
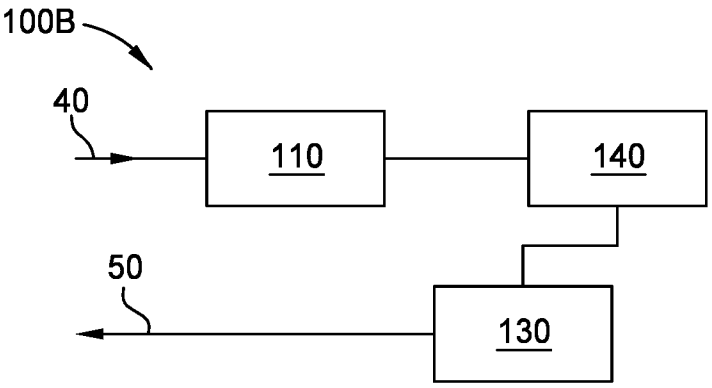

In FIG. 2B, the well testing package 100 is represented by well testing package 100B. The choke manifold 110 is coupled to the production line 40. Fluids conveyed from the well 12 through the production line 40 are routed from the choke manifold 110 to a separator 140. In some embodiments, the separator 140 is a three-phase separator. In some embodiments, the separator 140 facilitates measurement of the flowrate (such as mass flowrate or volumetric flowrate) of each of the gas phase, the oil phase, and the water phase. In some embodiments, the separator 140 is configured as a slug-catcher. Fluids are routed from the separator 140 to the multiphase pump 130. In an example, at least a portion of each of the separate gas, oil, and water phases are recombined at, or upstream of, the multiphase pump 130. The multiphase pump 130 boosts the pressure of the fluids, and conveys each phase of the fluids back to the well 12 via the injection line 50. In some embodiments, the well testing package 100B is operated without flaring or venting any portion of the fluids arriving via the production line 40.

In some embodiments, at least a portion of one or more of the phases separated by the separator 140, is not routed back to the well 12 via the injection line 50. In an example, at least a portion of a water phase is taken from the separator 140 for disposal into a dedicated disposal well. In another example, at least a portion of an oil phase is taken from the separator 140 to a production facility for further processing. In a further example, at least a portion of a gas phase is taken from the separator 140, and is injected into a gas production line.

Figure 2C:
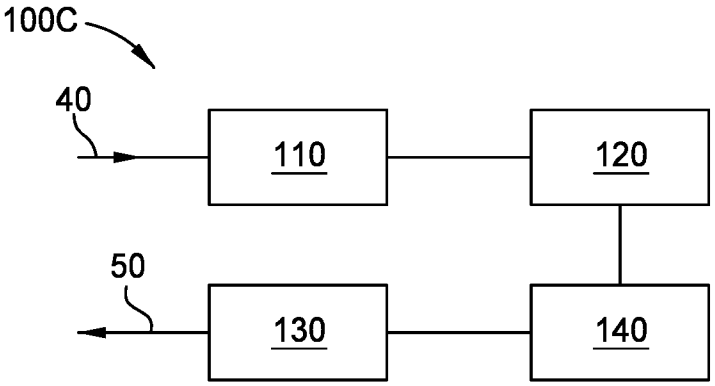

In FIG. 2C, the well testing package 100 is represented by well testing package 100C. The choke manifold 110 is coupled to the production line 40. Fluids conveyed from the well 12 through the production line 40 are routed from the choke manifold 110 to the multiphase flowmeter 120. Fluids are routed from the multiphase flowmeter 120 to the separator 140. In some embodiments, the separator 140 is configured as a slug-catcher. Fluids are routed from the separator 140 to the multiphase pump 130. In an example, at least a portion of each of the separate gas, oil, and water phases are recombined at, or upstream of, the multiphase pump 130. The multiphase pump 130 boosts the pressure of the fluids, and conveys each phase of the fluids back to the well 12 via the injection line 50. In some embodiments, the well testing package 100C is operated without flaring or venting any portion of the fluids arriving via the production line 40.

In some embodiments, at least a portion of one or more of the phases separated by the separator 140, is not routed back to the well 12 via the injection line 50. In an example, at least a portion of a water phase is taken from the separator 140 for disposal into a dedicated disposal well. In another example, at least a portion of an oil phase is taken from the separator 140 to a production facility for further processing. In a further example, at least a portion of a gas phase is taken from the separator 140, and is injected into a gas production line.

Figure 2D:
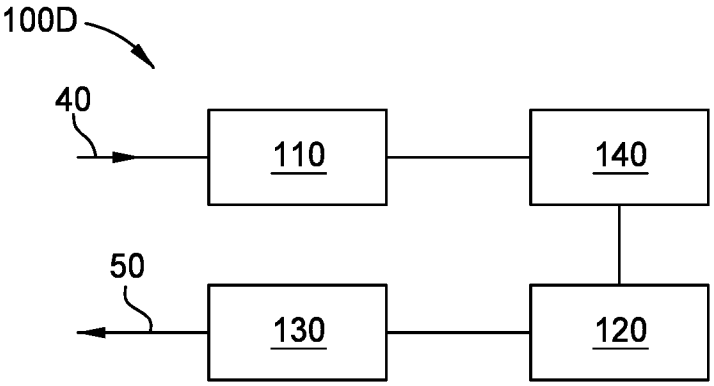

In FIG. 2D, the well testing package 100 is represented by well testing package 100D. The choke manifold 110 is coupled to the production line 40. Fluids conveyed from the well 12 through the production line 40 are routed from the choke manifold 110 to the separator 140. In some embodiments, the separator 140 is configured as a slug-catcher. Fluids are routed from the separator 140 to the multiphase flowmeter 120. In an example, at least a portion of each of the separate gas, oil, and water phases are recombined at, or upstream of, the multiphase flowmeter 120. Fluids are routed from the multiphase flowmeter 120 to the multiphase pump 130. The multiphase pump 130 boosts the pressure of the fluids, and conveys each phase of the fluids back to the well 12 via the injection line 50. In some embodiments, the well testing package 100D is operated without flaring or venting any portion of the fluids arriving via the production line 40.

In some embodiments, at least a portion of one or more of the phases separated by the separator 140, is not routed back to the well 12 via the injection line 50. In an example, at least a portion of a water phase is taken from the separator 140 for disposal into a dedicated disposal well. In another example, at least a portion of an oil phase is taken from the separator 140 to a production facility for further processing. In a further example, at least a portion of a gas phase is taken from the separator 140, and is injected into a gas production line.

In some embodiments, the well testing package 100 is composed according to any one of the arrangements disclosed in PCT Patent Application Publication No. WO 2023/075815 A1, the disclosure of which is incorporated herein by reference.

Figure 3:
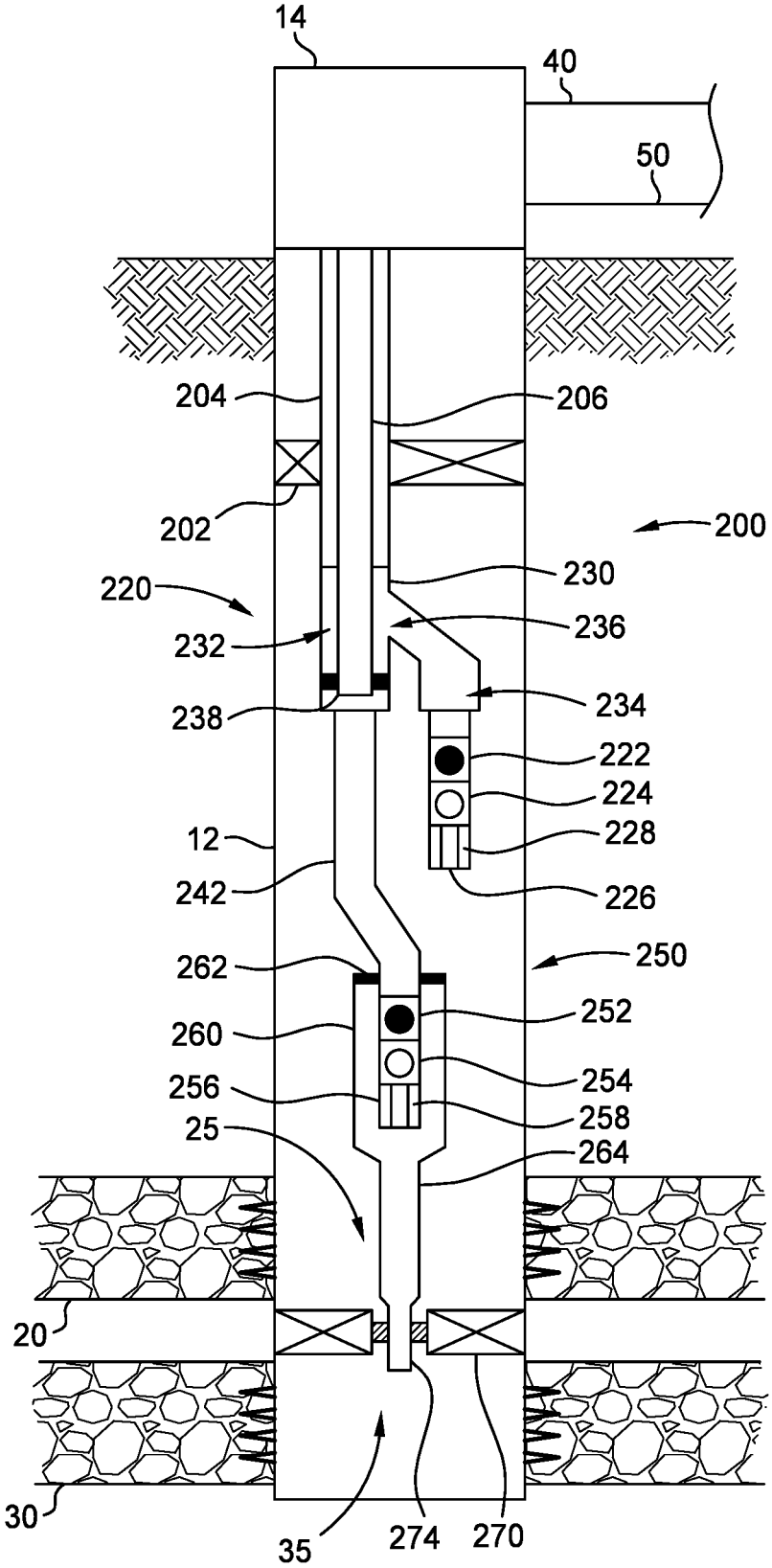
FIG. 3 schematically illustrates an exemplary well test completion installed in the well of FIG. 1.

FIG. 3 schematically illustrates an exemplary well test completion 200 installed in the well 12. The well test completion 200 includes, amongst other components, an upper packer 202, an upper test completion 220, and a lower test completion 250. An outer tubing string 204 extends from the wellhead 14 to the upper packer 202. An inner tubing string 206 is disposed inside the outer tubing string 204, and extends from the wellhead 14 and through the upper packer 202.

The upper test completion 220 includes a bypass tool 230, such as a "Y-Tool" available from Schlumberger Limited. The bypass tool 230 includes a main bore 232 and a branch bore 234 that intersects the main bore 232. The bypass tool 230 is coupled to the upper packer 202 at an upper end of the main bore 232 above the intersection 236 of the branch bore 234 with the main bore 232. The inner tubing string 206 extends into the main bore 232 and is coupled to the main bore 232 via a seal assembly 238 below the intersection 236 of the branch bore 234 with the main bore 232. As illustrated, in some embodiments, a valve 222 is coupled to the branch bore 234. In an example, the valve 222 is configured as a shut-off valve, such as a ball valve or a flapper valve that is configured to open and close in order to selectively permit or prevent, respectively, fluid flow through the branch bore 234. In some embodiments, the valve 222 is operated by remote control, such as via an electric line, a hydraulic line, or wirelessly (such as via an electromagnetic signal).

As illustrated, in some embodiments, an additional valve 224 is coupled to the branch bore 234. In an example, the valve 224 is a circulation valve that includes a sleeve that moves with respect to a port in a wall of the valve 224 to selectively permit or prevent, respectively, fluid flow through the port. In some embodiments, the valve 224 is operated by remote control, such as via an electric line, a hydraulic line, or wirelessly (such as via an electromagnetic signal).

As illustrated, in some embodiments, a gauge carrier 226 is coupled to the branch bore 234. The gauge carrier 226 holds a plurality of gauges 228 that measure temperature and pressure. In some embodiments, at least one gauge 228 measures the temperature and pressure of fluid inside the gauge carrier 226. In some embodiments, at least one gauge 228 measures the temperature and pressure of fluid outside the gauge carrier 226. In some embodiments, data from the gauges 228 is stored in a memory associated with the gauges 228. In some embodiments, data from the gauges 228 is transmitted to surface via a wire or wirelessly, such as via an electromagnetic signal.

In some embodiments, any one or more of the valve 222, the valve 224, or the gauge carrier 226 may be omitted. In some embodiments, the upper test completion 220 includes additional equipment, such as a further valve 222, a further valve 224, a further gauge carrier 226, or other equipment. In an example, the additional equipment includes a fluid sampler tool that is configured to capture a sample of fluid for subsequent retrieval. In some embodiments, the fluid sampler tool is operated by remote control, such as via an electric line, a hydraulic line, or wirelessly (such as via an electromagnetic signal).

The lower test completion 250 is coupled to the main bore 232 of the bypass tool 230, such as by an intermediate tubing string 242. As illustrated, in some embodiments, the lower test completion 250 includes a valve 252. In an example, the valve 252 is a shut-off valve, such as a ball valve or a flapper valve that is configured to open and close in order to selectively permit or prevent, respectively, fluid flow through the lower test completion 250. In some embodiments, the valve 252 is operated by remote control, such as via an electric line, a hydraulic line, or wirelessly (such as via an electromagnetic signal).

As illustrated, in some embodiments, the lower test completion 250 includes an additional valve 254. In an example, the valve 254 is a circulation valve that includes a sleeve that moves with respect to a port in a wall of the valve 254 to selectively permit or prevent, respectively, fluid flow through the port. In some embodiments, the valve 254 is operated by remote control, such as via an electric line, a hydraulic line, or wirelessly (such as via an electromagnetic signal).

As illustrated, in some embodiments, the lower test completion 250 includes a gauge carrier 256. The gauge carrier 256 holds a plurality of gauges 258 that measure temperature and pressure. In some embodiments, at least one gauge 258 measures the temperature and pressure of fluid inside the gauge carrier 256. In some embodiments, at least one gauge 258 measures the temperature and pressure of fluid outside the gauge carrier 256. In some embodiments, data from the gauges 258 is stored in a memory associated with the gauges 258. In some embodiments, data from the gauges 258 is transmitted to surface via a wire or wirelessly, such as via an electromagnetic signal.

In some embodiments, any one or more of the valve 252, the valve 254, or the gauge carrier 256 may be omitted. In some embodiments, the lower test completion 250 includes additional equipment, such as a further valve 252, a further valve 254, a further gauge carrier 256, or other equipment. In an example, the additional equipment includes a fluid sampler tool that is configured to capture a sample of fluid for subsequent retrieval. In some embodiments, the fluid sampler tool is operated by remote control, such as via an electric line, a hydraulic line, or wirelessly (such as via an electromagnetic signal).

As illustrated, a shroud 260 surrounds the valve 252, the valve 254, and the gauge carrier 256. The shroud 260 is sealingly coupled to the intermediate tubing string 242, such as via an adapter 262 above the valve 252. The shroud 260 extends beyond the valve 252, the valve 254, and the gauge carrier 256. A tail pipe 264 is coupled to the shroud 260, and is coupled to a lower packer 270. In an example, the tail pipe 264 is coupled to the lower packer 270 via a seal assembly 274.

The lower packer 270 is located between the first production zone 25 and the second production zone 35 of the well 12. The lower packer 270 impedes communication between the first production zone 25 and the second production zone 35 in the well 12. In some embodiments, the lower packer 270 is a permanent packer. In some embodiments, the lower packer 270 is a retrievable packer.

In some embodiments, the lower packer 270 is installed in the well 12 before the lower test completion 250 is installed in the well 12. In an example, the lower test completion 250, the intermediate tubing string 242, the upper test completion 220, the upper packer 202, and the outer tubing string 204 are installed in the well 12 together in a single trip. Then the inner tubing string 206 is installed in the well 12.

In some embodiments, the upper packer 202 is configured to be retrievable from the well 12. In an example, after the well 12 has been tested, the inner tubing string 206 is retrieved from the well 12, then the outer tubing string 204, the upper packer 202, the upper test completion 220, and the lower test completion 250 are retrieved from the well 12 together in a single trip. In some embodiments, the lower packer 270 is then retrieved from the well 12. In other embodiments, the lower packer 270 remains in the well 12.

Figure 4:
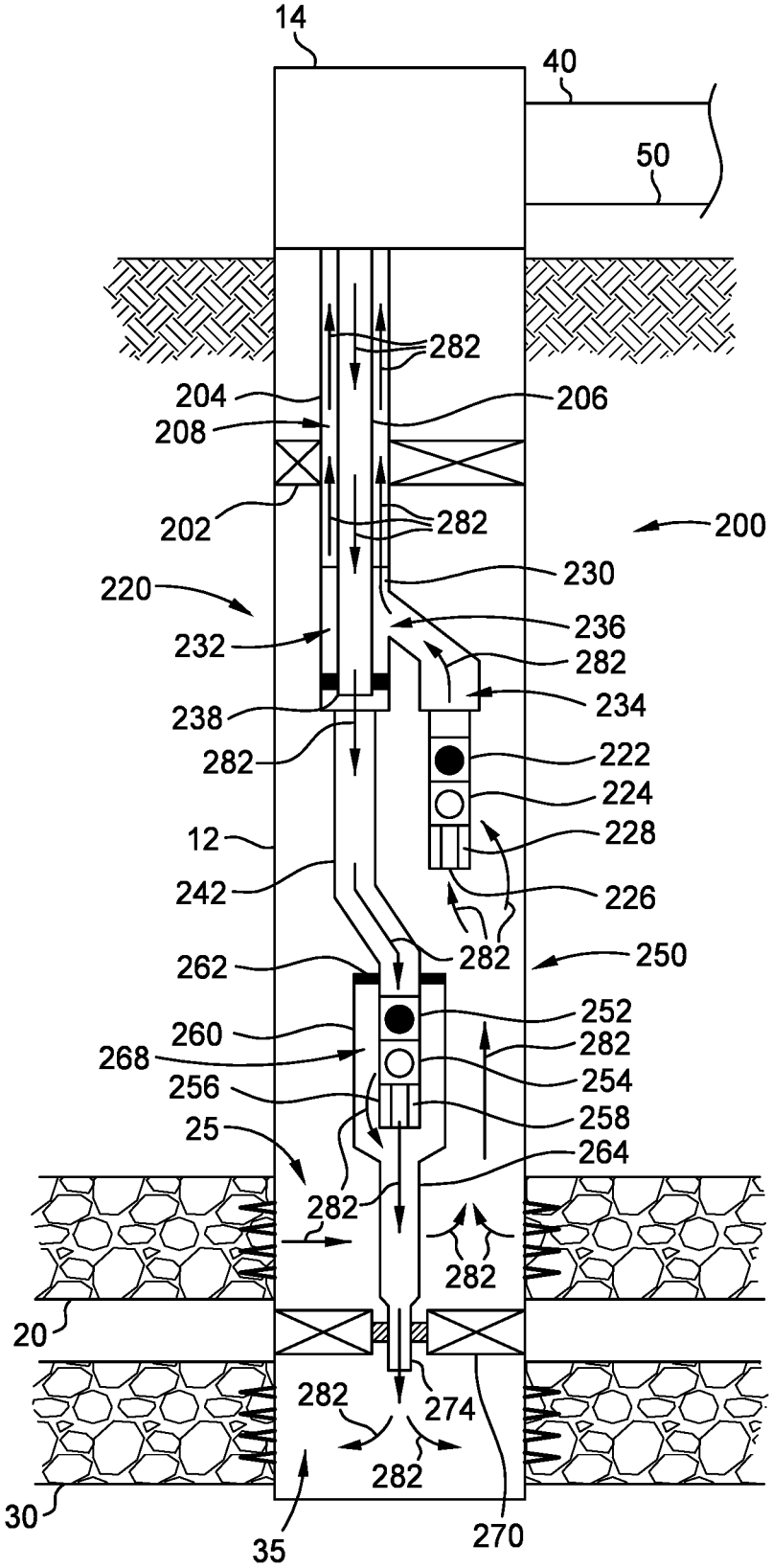
FIGS. 4 and 5 schematically illustrate exemplary fluid flow paths in the well test completion of FIG. 3.

FIG. 4 schematically illustrates exemplary fluid flow paths in the well test completion 200 of FIG. 3 during the testing of the first production zone 25. The valve 222 and the valve 224 are open to permit fluid to flow into the upper test completion 220. The valve 252 and the valve 254 are open to permit fluid to flow through the lower test completion 250. The fluid produced at the first production zone 25 is represented by arrows 282 indicating a flow of the fluid. The fluid enters the well 12 at the first production zone 25, and moves to the upper test completion 220. The fluid enters the upper test completion 220 through the valve 224. In some embodiments, at least a portion of the fluid enters the upper test completion 220 through the gauge carrier 226. The gauges 228 monitor the temperature and pressure of the fluid. The fluid flows through the valve 222, through the branch bore 234 of the bypass tool 230, and into the main bore 232 of the bypass tool 230. The fluid flows to the wellhead 14 in the annulus 208 between the outer tubing string 204 and the inner tubing string 206. The fluid flows from the wellhead 14 into the production line 40, and on to the well testing package 100.

Fluid returning to the wellhead 14 via the injection line 50 is routed into the inner tubing string 206. The fluid flows through the inner tubing string 206, and through the intermediate tubing string 242 to the lower test completion 250. The fluid flows through the valve 252. In some embodiments, at least a portion of the fluid flows through the valve 254 into the annulus 268 between the shroud 260 and the assembly of valve 252, valve 254, and gauge carrier 256. In some embodiments, at least a portion of the fluid flows through the gauge carrier 256 and into the shroud 260. The gauges 258 monitor the temperature and pressure of the fluid. The fluid flows from the shroud 260 and through the tail pipe 264 to the lower packer 270. The fluid exits the tail pipe 264 at or below the lower packer 270. The fluid is injected into the second production zone 35.

In some embodiments, a first portion of the fluid is injected into the second production zone 35 while simultaneously producing a second portion of the fluid from the first production zone 25 to the well testing package 100. In some embodiments, at least a portion of the fluid is injected into the second production zone 35 after ceasing production of the fluid from the first production zone 25. In an example, a portion of the fluid (such as a buffer volume of the fluid) may be temporarily stored at the well testing package 100 before injecting the fluid into the second production zone 35.

During production of the fluid from the first production zone 25, the gauges 228 monitor the drawdown pressure characteristics of the first production zone 25. In some embodiments, the valve 222 is closed after producing a portion of the fluid from the first production zone 25. The gauges 228 are then used to monitor a pressure build-up of the first production zone 25. During injection of the fluid into the second production zone 35, the gauges 258 monitor the injection pressure characteristics of the second production zone 35. In some embodiments, the valve 252 is closed after injecting a portion of the fluid into the second production zone 35. The gauges 258 are then used to monitor a pressure fall-off of the second production zone 35. In some embodiments, the valve 222 and the valve 252 are opened substantially simultaneously, such as within fifteen minutes, within ten minutes, within five minutes, within two minutes, within one minute, or within 30 seconds of each other. In some embodiments, the valve 222 and the valve 252 are closed substantially simultaneously, such as within fifteen minutes, within ten minutes, within five minutes, within two minutes, within one minute, or within 30 seconds of each other.

Figure 5:
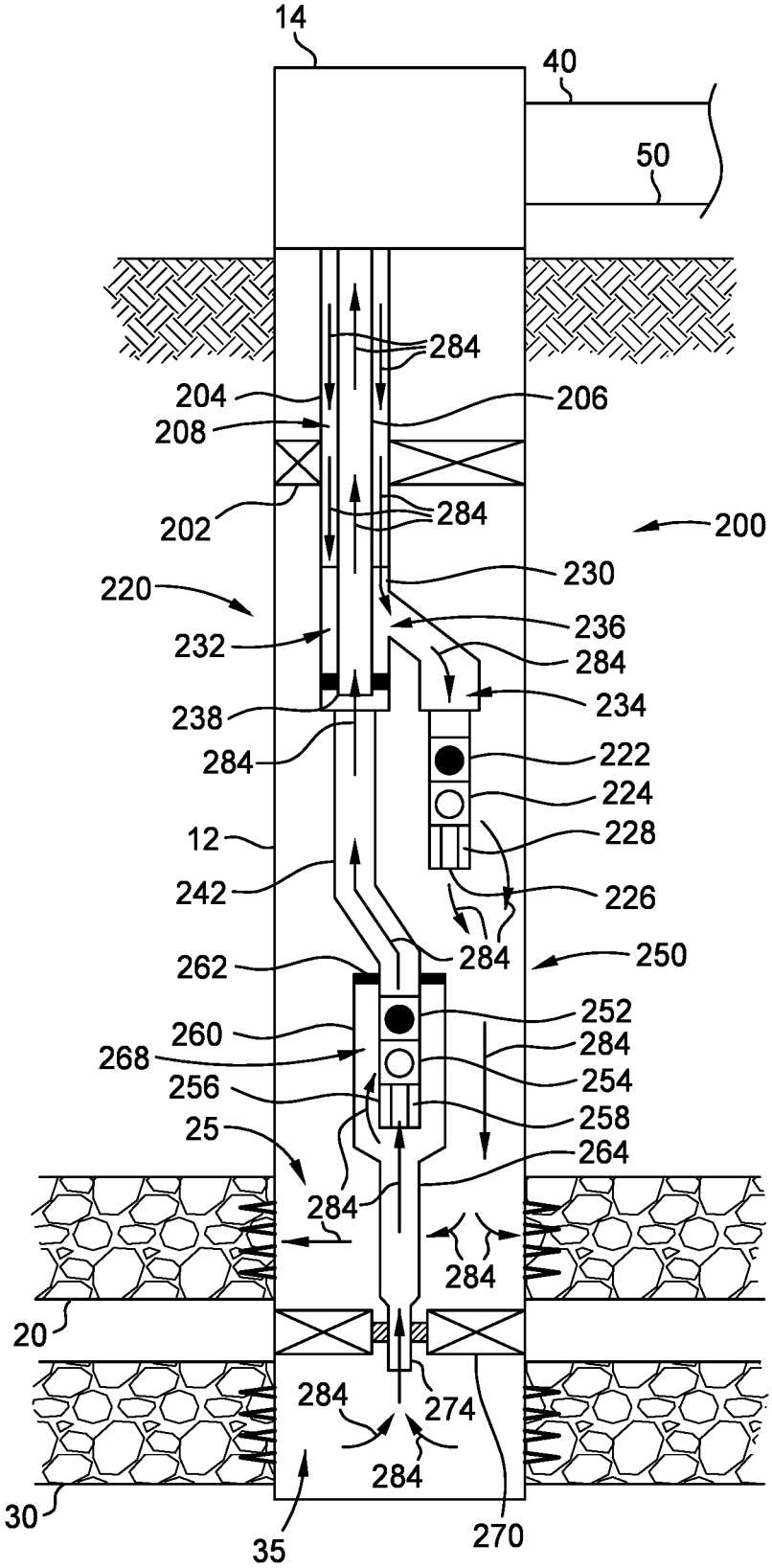

FIG. 5 schematically illustrates exemplary fluid flow paths in the well test completion 200 of FIG. 3 during the testing of the second production zone 35. The valve 222 and the valve 224 are open to permit fluid to flow through the upper test completion 220. The valve 252 and the valve 254 are open to permit fluid to flow through the lower test completion 250. The fluid produced at the second production zone 35 is represented by arrows 284 indicating a flow of the fluid. The fluid enters the well 12 at the second production zone 35, and moves to the lower test completion 250. The fluid enters the tail pipe 264 of the lower test completion 250 and travels through the tail pipe 264 to the shroud 260. In some embodiments, at least a portion of the fluid flows through the gauge carrier 256. In some embodiments, at least a portion of the fluid flows in the annulus 268 between the shroud 260 and the assembly of valve 252, valve 254, and gauge carrier 256. The portion of the fluid then flows through the valve 254. The gauges 258 monitor the temperature and pressure of the fluid. The fluid flows through the valve 252, through the intermediate tubing string 242, and into the inner tubing string 206. The fluid flows to the wellhead 14 through the inner tubing string 206. The fluid flows from the wellhead 14 into the production line 40, and on to the well testing package 100.

Fluid returning to the wellhead 14 via the injection line 50 is routed into the outer tubing string 204. The fluid flows through the annulus 208 between the outer tubing string 204 and the inner tubing string 206 to the bypass tool 230. The fluid flows into the branch bore 234 of the bypass tool 230, and through the valve 222. In some embodiments, at least a portion of the fluid exits the upper test completion 220 through a side port of the valve 224. In some embodiments, at least a portion of the fluid flows through the gauge carrier 226 before exiting the upper test completion 220. The gauges 228 monitor the temperature and pressure of the fluid. The fluid is injected into the first production zone 25.

In some embodiments, a first portion of the fluid is injected into the first production zone 25 while simultaneously producing a second portion of the fluid from the second production zone 35 to the well testing package 100. In some embodiments, at least a portion of the fluid is injected into the first production zone 25 after ceasing production of the fluid from the second production zone 35. In an example, a portion of the fluid (such as a buffer volume of the fluid) may be temporarily stored at the well 12 testing package before injecting the fluid into the first production zone 25.

During production of the fluid from the second production zone 35, the gauges 258 monitor the drawdown pressure characteristics of the second production zone 35. In some embodiments, the valve 252 is closed after producing a portion of the fluid from the second production zone 35. The gauges 258 are then used to monitor a pressure build-up of the second production zone 35. During injection of the fluid into the first production zone 25, the gauges 228 monitor the injection pressure characteristics of the first production zone 25. In some embodiments, the valve 222 is closed after injecting a portion of the fluid into the first production zone 25. The gauges 228 are then used to monitor a pressure fall-off of the first production zone 25. In some embodiments, the valve 222 and the valve 252 are opened substantially simultaneously, such as within fifteen minutes, within ten minutes, within five minutes, within two minutes, within one minute, or within 30 seconds of each other. In some embodiments, the valve 222 and the valve 252 are closed substantially simultaneously, such as within fifteen minutes, within ten minutes, within five minutes, within two minutes, within one minute, or within 30 seconds of each other.

Figure 6:
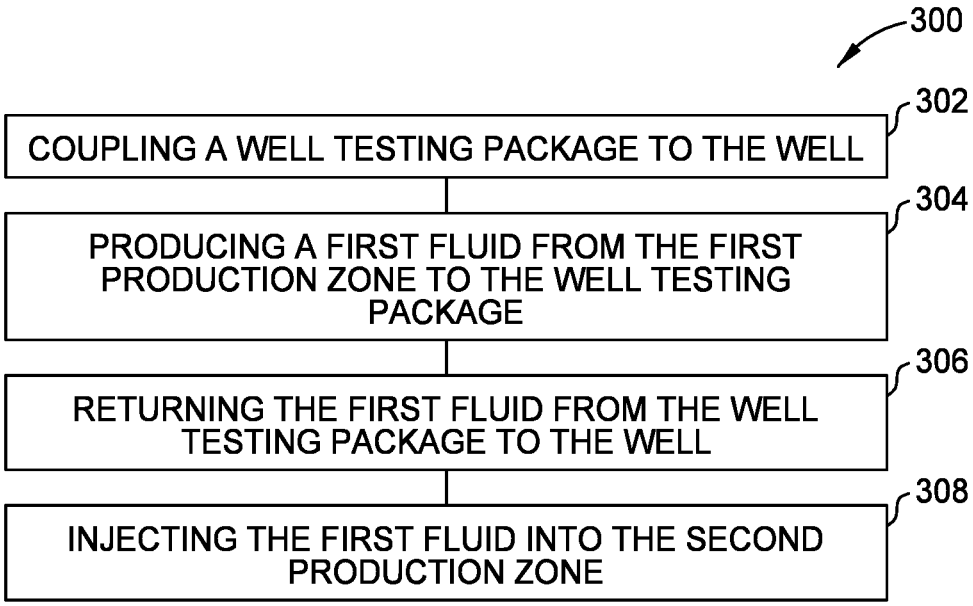
FIG. 6 is a flowchart of a method of testing first and second production zones of a well.

FIG. 6 is a flowchart of a method 300 of testing first and second production zones of a well (such as well 12). In some embodiments, the well is land-based. In some embodiments, the well is offshore. The method 300 may be performed using any of the systems and apparatus disclosed herein. At operation 302, the method 300 includes coupling a well testing package (such as well testing package 100/100A/100B/100C/100D) to the well. In an example, the well testing package is coupled to the well at a wellhead (such as wellhead 14).

At operation 304, the method 300 includes producing a first fluid from the first production zone to the well testing package. In some embodiments, operation 304 includes flowing the first fluid through a first tubing string in the well. In some embodiments, operation 304 includes conveying the first fluid through a production line to a choke manifold of the well testing package. In some embodiments, the first fluid includes a gas phase. In some embodiments, the first fluid includes an oil phase. In some embodiments, the first fluid includes a water phase.

In some embodiments, the method 300 includes measuring a flowrate of the first fluid. In some embodiments, the flowrate of the first fluid is measured using a multiphase flowmeter. In some embodiments, measuring the flowrate of the first fluid includes measuring a flowrate of each phase of the first fluid. The flowrate of each phase may be determined as a mass flowrate, a volumetric flowrate, or a molar flowrate.

At operation 306, the method 300 includes returning the first fluid from the well testing package to the well. In some embodiments, operation 306 includes using a multiphase pump to convey the first fluid through an injection line. In some embodiments, operation 306 includes conveying the first fluid into a second tubing string in the well. The second tubing string is different from the first tubing string.

At operation 308, the method 300 includes injecting the first fluid into the second production zone. In some embodiments, at least a component of a well test completion in the well impedes communication between the first production zone and the second production zone. In some embodiments, the method 300 includes injecting a first portion of the first fluid into the second production zone while simultaneously producing a second portion of the first fluid from the first production zone. In an example, operation 304 and operation 308 may be performed simultaneously.

In some embodiments, the method 300 includes producing a second fluid from the second production zone to the well testing package. In an example, the second fluid is flowed through the second tubing string in the well. In a further example, the second fluid is conveyed through the production line to the choke manifold of the well testing package. In some embodiments, the method 300 includes measuring a flowrate of the second fluid. In some embodiments, the flowrate of the second fluid is measured using a multiphase flowmeter. In some embodiments, measuring the flowrate of the second fluid includes measuring a flowrate of each phase of the second fluid. The flowrate of each phase may be determined as a mass flowrate, a volumetric flowrate, or a molar flowrate. In some embodiments, a composition of the first fluid and a composition of the second fluid are different.

In some embodiments, the method 300 includes returning the second fluid from the well testing package to the well, such as by using a multiphase pump to convey the second fluid through the injection line. In an example, the second fluid is conveyed into the first tubing string in the well. In some embodiments, the method 300 includes injecting the second fluid into the first production zone. In some embodiments, the method 300 includes injecting a first portion of the second fluid into the first production zone while simultaneously producing a second portion of the second fluid from the second production zone.

In some embodiments, the method 300 includes monitoring one of a pressure drawdown or a pressure build-up of the first production zone using a first gauge in the well. In some embodiments, the method 300 includes monitoring one of an injection pressure or a pressure fall-off of the first production zone using the first gauge in the well. In some embodiments, the method 300 includes monitoring one of a pressure drawdown or a pressure build-up of the second production zone using a second gauge in the well. In some embodiments, the method 300 includes monitoring one of an injection pressure or a pressure fall-off of the second production zone using the second gauge in the well.

In some embodiments, the method 300 includes taking one or more samples of the first fluid in the well. In an example, the one or more samples are taken using a fluid sampler tool that is installed as a component of the upper test completion (such as upper test completion 220). In some embodiments, the method 300 includes taking one or more samples of the second fluid in the well. In an example, the one or more samples are taken using a fluid sampler tool that is installed as a component of the lower test completion (such as lower test completion 250).

In some embodiments, the method 300 is performed without flaring or venting gas from the first fluid. In some embodiments, the method 300 is performed without flaring or venting gas from the second fluid. In some embodiments, the method 300 is performed without burning oil from the first fluid. In some embodiments, the method 300 is performed without burning oil from the second fluid.

Figure 7:
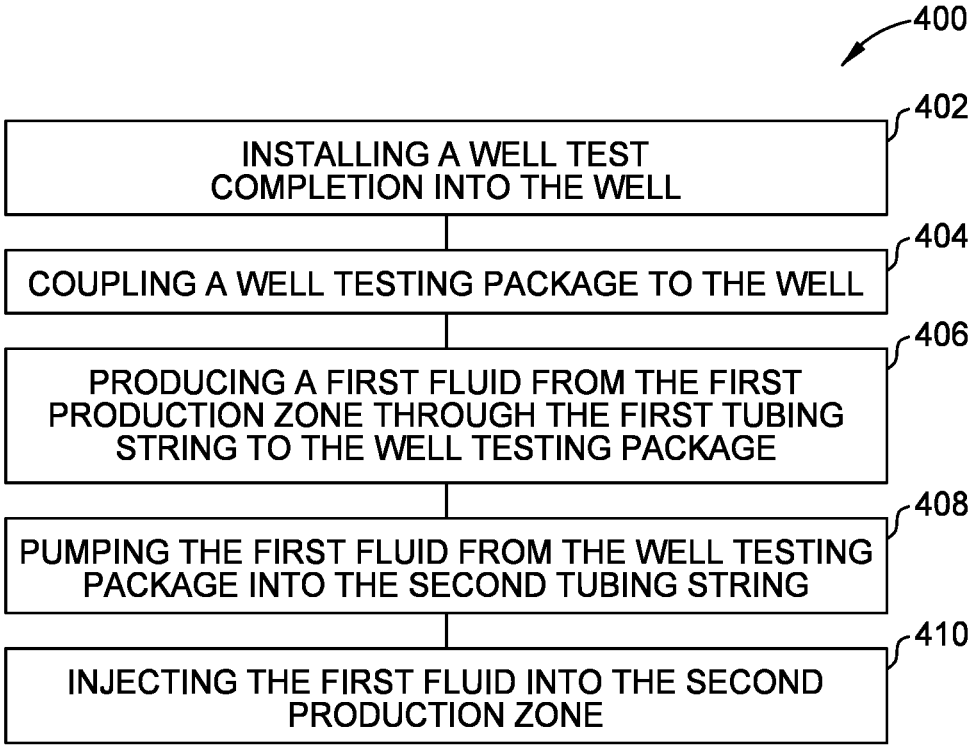
FIG. 7 is a flowchart of a method of testing first and second production zones of a well.

FIG. 7 is a flowchart of a method 400 of testing first and second production zones of a well (such as well 12). In some embodiments, the well is land-based. In some embodiments, the well is offshore. The method 400 may be performed using any of the systems and apparatus disclosed herein. At operation 402, the method 400 includes installing a well test completion (such as one or more components of well test completion 200) into the well. In an example, the well test completion includes first and second tubing strings. The second tubing string is different from the first tubing string. In some embodiments, at least a component of the well test completion in the well impedes communication between the first production zone and the second production zone.

At operation 404, the method 400 includes coupling a well testing package (such as well testing package 100/100A/100B/100C/100D) to the well. In an example, the well testing package is coupled to the well at a wellhead (such as wellhead 14).

At operation 406, the method 400 includes producing a first fluid from the first production zone through the first tubing string to the well testing package. In some embodiments, operation 406 includes conveying the first fluid through a production line to a choke manifold of the well testing package. In some embodiments, the first fluid includes a gas phase. In some embodiments, the first fluid includes an oil phase. In some embodiments, the first fluid includes a water phase.

In some embodiments, the method 400 includes measuring a flowrate of the first fluid. In some embodiments, the flowrate of the first fluid is measured using a multiphase flowmeter. In some embodiments, measuring the flowrate of the first fluid includes measuring a flowrate of each phase of the first fluid. The flowrate of each phase may be determined as a mass flowrate, a volumetric flowrate, or a molar flowrate.

At operation 408, the method 400 includes pumping the first fluid from the well testing package into the second tubing string. In some embodiments, operation 408 includes using a multiphase pump to convey the first fluid through an injection line.

At operation 410, the method 400 includes injecting the first fluid into the second production zone. In some embodiments, the method 400 includes injecting a first portion of the first fluid into the second production zone while simultaneously producing a second portion of the first fluid from the first production zone. In an example, operation 406 and operation 410 may be performed simultaneously.

In some embodiments, the method 400 includes closing a downhole valve of the well test completion to halt the production of the first fluid from the first production zone. In some embodiments, closing the downhole valve is performed by remote control, such as via an electric line, a hydraulic line, or wirelessly (such as via an electromagnetic signal). In an example, the downhole valve is valve 222.

In some embodiments, the method 400 includes monitoring a pressure build-up of the first production zone using a gauge of the well test completion. In an example, the gauge is gauge 228.

In some embodiments, the method 400 includes producing a second fluid from the second production zone through the second tubing string to the well testing package. In an example, the second fluid is conveyed through the production line to the choke manifold of the well testing package. In some embodiments, the method 400 includes measuring a flowrate of the second fluid. In some embodiments, the flowrate of the second fluid is measured using a multiphase flowmeter. In some embodiments, measuring the flowrate of the second fluid includes measuring a flowrate of each phase of the second fluid. The flowrate of each phase may be determined as a mass flowrate, a volumetric flowrate, or a molar flowrate. In some embodiments, a composition of the first fluid and a composition of the second fluid are different.

In some embodiments, the method 400 includes pumping the second fluid from the well testing package into the first tubing string, such as by using a multiphase pump to convey the second fluid through the injection line. In some embodiments, the method 400 includes injecting the second fluid into the first production zone. In some embodiments, the method 400 includes injecting a first portion of the second fluid into the first production zone while simultaneously producing a second portion of the second fluid from the second production zone.

In some embodiments, the method 400 includes closing a downhole valve of the well test completion to halt the production of the second fluid from the second production zone. In some embodiments, closing the downhole valve is performed by remote control, such as via an electric line, a hydraulic line, or wirelessly (such as via an electromagnetic signal). In an example, the downhole valve is valve 252.

In some embodiments, the method 400 includes monitoring a pressure build-up of the second production zone using a gauge of the well test completion. In an example, the gauge is gauge 258.

In some embodiments, the method 400 includes taking one or more samples of the first fluid in the well. In an example, the one or more samples are taken using a fluid sampler tool that is installed as a component of the upper test completion (such as upper test completion 220). In some embodiments, the method 400 includes taking one or more samples of the second fluid in the well. In an example, the one or more samples are taken using a fluid sampler tool that is installed as a component of the lower test completion (such as lower test completion 250).

In some embodiments, the method 400 includes retrieving the well test completion from the well.

In some embodiments, the method 400 is performed without flaring or venting gas from the first fluid. In some embodiments, the method 400 is performed without flaring or venting gas from the second fluid. In some embodiments, the method 400 is performed without burning oil from the first fluid. In some embodiments, the method 400 is performed without burning oil from the second fluid.

It is contemplated that any operation, activity, or example related to the method 300 may be incorporated into the method 400. It is further contemplated that any operation, activity, or example related to the method 400 may be incorporated into the method 300.

Embodiments of the present disclosure provide systems, apparatus, and methods for testing a well. The testing may be accomplished without flaring or venting gas produced from the well. The testing may be accomplished without burning oil produced from the well. Compared to conventional techniques, embodiments of the present disclosure provide environmental benefits and avert unwanted wastage of resources by the avoidance of flaring or venting produced gas and the avoidance of burning produced oil.

It is contemplated that any one or more elements or features of any one disclosed embodiment or example may be beneficially incorporated in any one or more other non-mutually exclusive embodiments or examples. While the foregoing is directed to embodiments of the present disclosure, other and further embodiments of the disclosure may be devised without departing from the basic scope thereof, and the scope thereof is determined by the claims that follow.

The following claims are not intended to be limited to the aspects shown herein, but are to be accorded the full scope consistent with the language of the claims. Within a claim, reference to an element in the singular is not intended to mean "one and only one" unless specifically so stated, but rather "one or more." Unless specifically stated otherwise, the term "some" refers to one or more. No claim element is to be construed under the provisions of 35 U.S.C. § 112(f) unless the element is expressly recited using the phrase "means for". All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

What is claimed is:

1. A method of testing first and second production zones of a well, comprising:

coupling a well testing package to the well, the well testing package being located at surface;

producing a first fluid from the first production zone;

sending the first fluid from the well to the well testing package, wherein sending the first fluid from the well to the well testing package comprises flowing the first fluid through a first tubing string in the well;

returning the first fluid from the well testing package to the well, wherein returning the first fluid from the well testing package to the well comprises using a multiphase pump of the well testing package to convey the first fluid into a second tubing string in the well;

injecting the returned first fluid into the second production zone;

producing a second fluid from the second production zone;

sending the second fluid from the well to the well testing package, wherein sending the second fluid from the well to the well testing package comprises flowing the second fluid through the second tubing string in the well;

returning the second fluid from the well testing package to the well, wherein returning the second fluid from the well testing package to the well comprises using the multiphase pump to convey the second fluid into the first tubing string in the well; and injecting the second fluid into the first production zone while simultaneously producing additional second fluid from the second production zone and sending the additional second fluid from the well to the well testing package.

2. The method of claim 1, wherein a well test completion in the well impedes communication between the first production zone and the second production zone.

3. The method of claim 1, further comprising measuring a flowrate of the first fluid using a multiphase flow meter.

4. The method of claim 1, further comprising:

monitoring one of a pressure drawdown or a pressure build-up of the first production zone using a first gauge in the well; and monitoring one of a pressure drawdown or a pressure build-up of the second production zone using a second gauge in the well.

5. A method of testing first and second production zones of a well, comprising:

installing a well test completion into the well, the well test completion including first and second tubing strings;

coupling a well testing package to the well, the well testing package being located at surface;

producing a first fluid from the first production zone;

sending the first fluid through the first tubing string to the well testing package;

pumping the first fluid from the well testing package into the second tubing string;

injecting the first fluid into the second production zone while simultaneously producing additional first fluid from the first production zone and sending the additional first fluid through the first tubing string to the well testing package;

closing a downhole valve of the well test completion to halt the production of the first fluid from the first production zone; and monitoring a pressure build-up of the first production zone using a gauge of the well test completion.

6. The method of claim 5, further comprising measuring a flowrate of the first fluid using a multiphase flow meter.

7. The method of claim 5, wherein pumping the first fluid from the well testing package into the second tubing string comprises pumping the first fluid using a multiphase pump.

8. A method of testing first and second production zones of a well, comprising:

installing a well test completion into the well, the well test completion including first and second tubing strings;

coupling a well testing package to the well, the well testing package being located at surface;

producing a first fluid from the first production zone through the first tubing string to the well testing package;

pumping the first fluid from the well testing package into the second tubing string;

injecting the first fluid into the second production zone;

producing a second fluid from the second production zone;

sending the second fluid through the second tubing string to the well testing package;

pumping the second fluid from the well testing package into the first tubing string; and injecting the second fluid into the first production zone while simultaneously producing additional second fluid from the second production zone and sending the additional second fluid through the second tubing string to the well testing package.

9. The method of claim 8, further comprising measuring a flowrate of the first fluid using a multiphase flow meter.

10. The method of claim 8, further comprising:

closing a downhole valve of the well test completion to halt the production of the first fluid from the first production zone; and monitoring a pressure build-up of the first production zone using a gauge of the well test completion.

11. The method of claim 8, wherein pumping the first fluid from the well testing package into the second tubing string comprises pumping the first fluid using a multiphase pump.

12. The method of claim 8, further comprising:

closing a downhole valve of the well test completion to halt the production of the second fluid from the second production zone; and monitoring a pressure build-up of the second production zone using a gauge of the well test completion.

13. The method of claim 8, wherein the well test completion in the well impedes communication between the first production zone and the second production zone.

* * * * *